US006770582B1

(12) United States Patent
Copperwheat

(10) Patent No.: US 6,770,582 B1
(45) Date of Patent: Aug. 3, 2004

(54) ADHESIVE COATED POLYESTER FELT

(75) Inventor: Stephen D. Copperwheat, Rome, NY (US)

(73) Assignee: Knowlton Nonwovens, Inc., Utica, NY (US)

( * ) Notice: Subject to any disclaimer, the term of this patent is extended or adjusted under 35 U.S.C. 154(b) by 149 days.

(21) Appl. No.: 09/961,531

(22) Filed: Sep. 24, 2001

Related U.S. Application Data

(63) Continuation-in-part of application No. 09/198,546, filed on Nov. 24, 1998, now abandoned.

(51) Int. Cl.[7] ..... D04H 1/08

(52) U.S. Cl. ..... 442/320; 442/149; 442/268; 442/270; 442/286; 442/323; 442/381; 442/394; 442/402; 428/42.3; 428/343; 428/355 EP; 428/354; 428/904

(58) Field of Search ..... 442/149; 428/42.3, 428/343, 354, 355 EP, 904; 427/208

(56) References Cited

U.S. PATENT DOCUMENTS 5,532,050 A * 7/1996 Brooks ..... 428/220
5,874,136 A * 2/1999 Michna et al. ..... 428/31
6,008,149 A * 12/1999 Copperwheat ..... 442/381

FOREIGN PATENT DOCUMENTS

WO WO 99/46116 9/1999

* cited by examiner

*Primary Examiner*—Arti R. Singh
(74) *Attorney, Agent, or Firm*—Wall Marjama & Bilinski LLP

(57) ABSTRACT

A composite laminate suitable for use in upholstery, automotive interiors and the like, which is made of a polyester felt substrate, an adhesive coating is contained on said felt substrate which obviates the need for a barrier layer for a vinyl laminate, with a vinyl film overlaying and bonding with said adhesive to said substrate. The method of making the laminate is also disclosed.

4 Claims, No Drawings

ADHESIVE COATED POLYESTER FELT

CROSS REFERENCE TO RELATED APPLICATIONS

This application is a continuation-in-part of application Ser. No. 09/198,546, filed Nov. 24, 1998 now abandoned.

BACKGROUND OF THE INVENTION

The present invention relates in general to a composite laminate and more specifically to a laminate suitable for use with other laminates such as vinyl.

Vinyl coatings are used for a wide variety of products including furniture, seating covers, upholstery and automotive interiors. Substrates for vinyl coating today are produced from various layers of materials which each have a function. A conventional state of the art construction for the supporting substrate is:

100% polyester needlepunch felt low density open-celled polyurethane foam

The above structure is then coated with an adhesive. A layer of vinyl polymeric film is then calendered and adhered to the substrate to produce the final laminate product.

The function of each layer is as follows:

Polyester felt—provides the laminate handle, softness, suppleness, and compressibility properties appropriate for use in the manufacture of furniture, luggage, or automotive interiors.

Polyurethane foam—is added to the felt to act as a barrier to keep the adhesive out of the felt to maintain the product soft and supple for the particular application. If the adhesive penetrates the felt, it tends to stiffen the final product and it becomes boardy. The foam has no other function, and does not enhance any of the other properties of the felt sheet. It is an added cost whose function could also be met by the addition of a film laminated to the felt, which is also expensive. The foam also adversely impacts recyclability of the substrate in that the polyurethane is not compatible with polyester when recycling plastics. It is also known that the polyurethane foam, when burned, will decompose to cyanide gas which is a safety issue with this material construction.

In adhering the vinyl coating to the substrate, an adhesive coating, typically a water-based latex, is used. The dimensional stability of this product is an ongoing problem with the laminate manufacturing process.

It can be seen from the above that there is a need for lower cost felt substrates, and furthermore, a substrate which can overcome the problems described above which are associated with current substrates.

SUMMARY OF THE INVENTION

It is therefore an object of the present invention to provide a relatively low cost adhesive coated felt.

It is another object of the present invention to provide an adhesive coating for a felt which obviates the need for a barrier layer and reduces production cost.

It is a further object of the present invention to provide an economical adhesive coated felt having improved physical properties.

It is yet another object of the present invention to provide an improved adhesive for a felt which eliminates the need for a separate foam barrier layer.

These and other objects are accomplished in accordance with the present invention whereby an adhesive is applied to and resides on the surface of a felt support to provide superior adhesion to vinyl and overcomes the need to prevent adhesive penetration into the felt layer.

More specifically the present invention allows for the elimination of the polyurethane foam by applying a high viscosity adhesive coating to the surface of the felt. Although the present invention illustrates the use of a polyester felt, it should be understood that any suitable felt may be used. For example, nylon, polypropylene, rayon and polyacrylic felts may also be used. The resulting structure has the following advantages over the existing state of the art:

1. Lower cost product.

2. The coating of adhesive does not penetrate into the body of the felt. It is believed that the adhesive resides mainly on the substrate surface, and at most, penetrates only a few fiber thicknesses into the body of the substrate. This provides for substantially all of the adhesive being available for bonding. This objective can be achieved by combination of application techniques and adhesive viscosities. One suitable method of accomplishing the above objective would be the use of a Stork Foam Adhesive Applicator for applying the appropriate adhesive substrate. Because it acts as an adhesive layer and overcomes the need for a barrier layer for the vinyl, the need for a separate polyurethane foam barrier layer is eliminated. The resulting product is very soft and supple.

3. Because most of the adhesive stays directly on top of the felt surface and is available for adhesion, much less adhesive is required to adhere the vinyl polymeric film to the felt layer. The process of the invention uses between about 0.2 and 0.4 oz/yd$^2$ of adhesive addition versus the industry standard of 1.0 to 5.0 oz/yd$^2$. Any process capable of adding the adhesive to the top of a fabric is acceptable for producing this product. This would include coating processes that apply pastes, powdered foamed adhesive processes, hot melt adhesive processes, and any spray processes that can spray thixotropic materials.

DETAILED DESCRIPTION OF THE INVENTION

A conventional polyester felt with a 0.030 inches thick polyurethane foam layer on one surface of the polyester is made as follows: Fiber bales are opened and fiber is loaded into fiber hoppers and preblended into a specific weight blend. The polyester fiber is 75% 3 denier×3", 25% 1.5 denier×1.5" available from Hoechst Celanese. Fiber bundles are further mixed and opened and transported by air to a holding bin to feed the card process. Blended and opened fibers are fed to the card which combs fibers into a fibrous web. Webs are layered one on top of another by a crosslapper to build a heavy weight feed mat to feed the needle looms. The resultant feed mat is about 6.0 oz/yd$^2$ Crosslapped web is then fed to a needle loom. Barbed needles pass through the web and entangle fibers together to provide strength to the web. The web is stretched in the machine direction and the web weight drops to about 4.5 oz/yd$^2$. The polyurethane foam is unrolled and laid onto the top of the needled web as it exits the first loom. The foam is 0.030" thick polyurethane foam type LDM, 0.5 oz/yd$^2$ (LDM=low density, mildew resistant) available from WM. T. Burnett Co. or General Foam Corp. The needled web/foam combination is then passed through an second needle loom as it is being stretched in the machine direction and the fibers from the web are carried into the foam by the needling action. This forms a sheet of composite material with a final weight of about 4.0 oz/yd$^2$. The sheet is then slit into three 62"-wide rolls. Subsequent process steps are packaging and testing. The rolls are then ready for lamination with vinyl. It should be understood that the width of the sheet can vary depending upon use requirements.

To produce the adhesive coated substrate of the present invention, the above process is repeated except that the polyurethane foam processing is eliminated. After the needle punching to form the polyester felt web, the web is fed through a second needle loom as it is being stretched in the machine direction to finish the base web. This forms a final sheet of polyester felt product with a weight of 4.0 oz/yd$^2$. The sheet is slit into three 62"-wide rolls. Subsequent process steps are packaging and testing. The rolls are then sent to a coater for adhesive addition. A roll of 4.0 oz/yd$^2$ polyester felt is unwound and fed into a coating machine. A high viscosity hot melt polyester based adhesive (GRILTEX® 9 and the other four adhesives listed in Table I are all available from EMS-American Grilon, Inc.) is applied to the face of the sheet and dried. This adhesive has a viscosity of about 130×10$^3$ centipoise at 180° C. Acceptable adhesives include liquid adhesives, hot melt adhesives, frothed or foamed or sprayed adhesives, powdered adhesives and web adhesives. Any process that can apply these materials to the surface of a felt without them penetrating significantly into the depth of the felt base fabric are acceptable. The adhesive-coated sheet is then dried in an oven and wound onto a roll for final quality testing for lamination with vinyl.

TABLE I

| Adhesive | Applicable Temp. Range (Deg. C) | Viscosity in the Applicable Temp. Range (Centipoise) | Application Temperature (° C.) | Viscosity @ The Temp. of Application (Centipoise) |
|---|---|---|---|---|
| GRILTEX ® D 1439E | 130–200 | (2,200–460) × 10$^3$ | 180 | 750 × 10$^3$ |
| GRILTEX ® 9 | 130–240 | (560–27) × 10$^3$ | 180 | 130 × 10$^3$ |
| GRILTEX ® 6 | 130–240 | (1,600–60) × 10$^3$ | 180 | 300 × 10$^3$ |
| GRILTEX ® D 1309E | 160–250 | (200–20) × 10$^3$ | 180 | 150 × 10$^3$ |
| GRILTEX ® D 1310E | 180–240 | (62–13) × 10$^3$ | 180 | 60 × 10$^3$ |

Therefore, the viscosity of the adhesive suitable for this application can vary over a very wide range, i.e., from 13×10$^3$ to as high as 2,220×10$^3$. The useful temperature range for the application of these adhesives is between 120–240° C. However, a preferred temperature range for application of the adhesives would be 150–210° C. An even more preferred temperature range for the application of these adhesives would be 170–190° C. A still more preferred range for the application of these adhesives would be 175–185(° C.). For viscosity, a preferred viscosity range would be 13×10$^3$–2,220×10$^3$. A more preferred viscosity range for adhesives for this application would be 60×10$^3$–2,000×10$^3$. A still more preferred viscosity range for adhesives for this application would be 100×10$^3$–800×10$^3$.

The following comparative test data illustrates the advantages of the present invention over the prior art described above.

TABLE II

Comparison of Prior Art Versus Invention

| Process Comparison | Prior Art | Invention Example 1 |
|---|---|---|
| Adhesive weight applied (oz/yd$^2$) | 0.9 | 0.28 |
| Laminator line speed (ypm) | 18 | 18 |
| Temperatures (° F.) | | |
| Drum roll | 290–315 | 250 |
| Radiant heat | 300–320 | 300–320 |
| Embossing Pressure (psi) | 700 | 700 |
| Vinyl exposure time (sec) | | |
| Drum roll | 3 | 3 |
| Radiant heat | 6 | 6 |
| Total | 30 | 30 |
| Adhesive type | proprietary | EMS Griltex9P |
| Adhesive Viscosity (@25° C. centipoise) | 3000–8000 | 130,000 |
| Nonwoven base needlepunch fabric | 100% PET | 100% PET |
| Base fabric basis weight (oz/yd$^2$) | 4.0 | 4.0 |

Test results (according to Chrysler Specification MS-JKS3-56)

| Test | Spec. Value | 0.28 oz/yd$^2$ |
|---|---|---|
| Weight oz/yd$^2$) | 21 +/− 2 | 20.2<br>21.0<br>20.5 |
| Bond (lbf/inch) | 5.5 | 14.72, 16.48, 15.47 |
| Grain Retention | TBD | excellent |

It can be seen from the above test data that the process and resulting product of the present invention can use as low as ¼ of the adhesive required by conventional prior art processing. It also provides for superior bond strength with the vinyl polymeric film while providing a product which is soft and supple.

A preferred range of adhesive add on is in the range of about 0.1 to 0.3 oz/yd$^2$. By proper selection of the adhesive type, the adhesive concentration can be increased up to about 0.90 oz/yd$^2$. A range of about 0.05 to 0.90 oz/yd$^2$ represents the operative range for adhesive concentrations of the present invention. Concentrations below about 0.05 oz/yd$^2$ do not provide sufficient bond strength to produce an acceptable laminate, while concentrations above about 0.90 oz/yd$^2$ result in unacceptable softness and handle properties in the laminate. Furthermore, because the high viscosity adhesive coating does not substantially penetrate into the felt, this obviates the need for a barrier layer for the vinyl, and overcomes the need for a separate polyurethane foam barrier layer. The above advantages provide for a more simple and economical process which results in a product which exhibits superior physical properties.

While the present invention has been particularly shown and described with reference to the preferred mode as illustrated in the drawing, it will be understood by one skilled in the art that various changes in detail may be effected therein without departing from the spirit and scope of the invention as defined by the claims.

What is claimed is:

1. A soft, supple adhesive coated felt suitable for use in laminating with vinyl which consists essentially of:

(a) a support in the form of a sheet of felt having an upper and lower planar surface; and (b) an adhesive coating contained on one of said surfaces in a concentration of about 0.05 to 0.90 oz/yd$^2$, with said coating being suitable for direct bonding with vinyl said adhesive having a viscosity in the range of about $6\times10^4$ to $7.5\times10^5$ centipoise at the temperature of application whereby said adhesive does not significantly penetrate into the depth of the felt.

2. A soft, supple adhesive coated felt suitable for use in laminating with vinyl which consists essentially of:

(a) a support in the form of a needlepunch felt having an upper and lower flat planar surface; and (b) an adhesive coating contained on one of said surfaces in maximum concentration of about 0.3 oz/yd$^2$, with said concentration being in an amount sufficient to firmly bond with vinyl and also obviates the need for a barrier layer, with said adhesive having a viscosity in the range of about $6\times10^4$ to $7.5\times10^5$ centipoise at the temperature of application whereby said adhesive does not significantly penetrate into the depth of the felt.

3. A soft, supple composite laminate suitable for use in upholstery, furniture, and automotive interiors which consists essentially of:

(a) a needlepunch felt having two flat planar surfaces;

(b) an adhesive coating contained on one of said surfaces in a concentration of about 0.05 to 0.90 oz/yd$^2$ with said coating obviating the need for a barrier layer for vinyl; and (c) a vinyl polymeric film laminated and bonded on to said adhesive layer, with said adhesive having a viscosity in the range of about $6\times10^4$ to $7.5\times10^5$ centipoise at the temperature of application whereby said adhesive does not significantly penetrate into the depth of the felt.

4. A felt as in claim 1 in which the felt comprises substantially 100% polyester fiber.

* * * * *